US009433852B2

(12) United States Patent
Colon

(10) Patent No.: US 9,433,852 B2
(45) Date of Patent: Sep. 6, 2016

(54) WHEEL FOR SPORTS EQUIPMENT

(71) Applicant: PERFORMANCE SK8 HOLDING INC, Las Vegas, NV (US)

(72) Inventor: Becket Colon, Vallentuna (SE)

(73) Assignee: PERFORMANCE SK8 HOLDING INC, Las Vegas, NV (US)

( * ) Notice: Subject to any disclaimer, the term of this patent is extended or adjusted under 35 U.S.C. 154(b) by 176 days.

(21) Appl. No.: 14/363,309

(22) PCT Filed: Dec. 7, 2012

(86) PCT No.: PCT/SE2012/051352
§ 371 (c)(1),
(2) Date: Jun. 6, 2014

(87) PCT Pub. No.: WO2013/085460
PCT Pub. Date: Jun. 13, 2013

(65) Prior Publication Data

US 2014/0319899 A1 Oct. 30, 2014

Related U.S. Application Data

(60) Provisional application No. 61/579,371, filed on Dec. 22, 2011.

(30) Foreign Application Priority Data

Dec. 7, 2011 (SE) ..... 1151168

(51) Int. Cl.
*A63C 17/22* (2006.01)
*A63C 17/24* (2006.01)

(52) U.S. Cl.
CPC ..... *A63C 17/22* (2013.01); *A63C 2203/08* (2013.01)

(58) Field of Classification Search
CPC ..... A63C 17/22; A63C 17/24
See application file for complete search history.

(56) References Cited

U.S. PATENT DOCUMENTS

| | | | | |
|---|---|---|---|---|
| 4,699,432 | A * | 10/1987 | Klamer | A63C 17/22 152/210 |
| 5,401,037 | A | 3/1995 | O'Donnell et al. | |
| 5,527,100 | A | 6/1996 | O'Donnell et al. | |
| 6,260,861 | B1 * | 7/2001 | Chiang | A63C 17/22 280/11.221 |
| 6,953,225 | B2 | 10/2005 | Gallagher et al. | |
| 2004/0217644 | A1 | 11/2004 | Gallagher et al. | |

FOREIGN PATENT DOCUMENTS

EP 0 652 035 A1 5/1995

OTHER PUBLICATIONS

International Search Report (PCT/ISA/210) mailed on Feb. 15, 2013, by the Swedish Patent Office as the International Searching Authority for International Application No. PCT/SE2012/051352.

* cited by examiner

*Primary Examiner* — John Walters
*Assistant Examiner* — James Triggs
(74) *Attorney, Agent, or Firm* — Buchanan Ingersoll & Rooney PC

(57) ABSTRACT

A wheel for a skateboard, roller skate or the like has a radial surface arranged to provide contact with the ground, said radial surface comprising areas of at least a first material and areas of a second material, said second material having at least one mechanical property differing from that of the first material. The first and second materials are arranged in such a way that they form a pattern on the radial surface which varies around the circumference of the wheel. This enables the adaptation of the behavior of the wheel in a very flexible way.

17 Claims, 3 Drawing Sheets

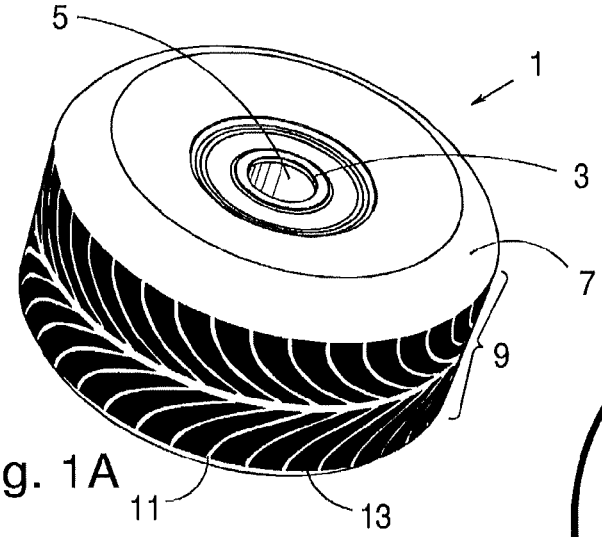
Fig. 1A
Fig. 1B
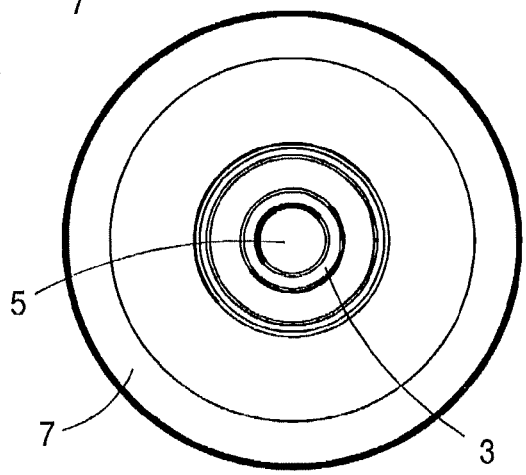
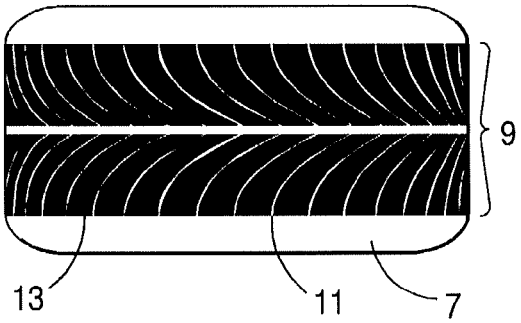
Fig. 1C
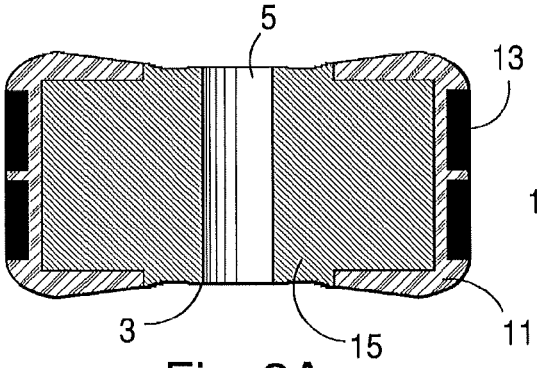
Fig. 2A
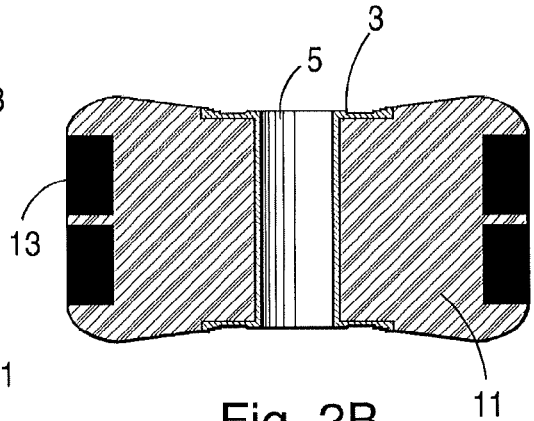
Fig. 2B

WHEEL FOR SPORTS EQUIPMENT

The present invention relates to the field of wheels for sports or leisure equipment such as skateboards, inlines and the like, and more specifically to wheels having a radial surface comprising at least two different materials having different mechanical properties.

BACKGROUND AND PRIOR ART

The wheels of a skateboard are typically made of polyurethane and come in many different sizes and shapes adapted to different types of skating.

It is also well known that the properties of the surface material affect the behavior of the skateboard. Polyurethane, which can be found with different friction coefficients, rolling resistance, and rebound depending on the mechanical properties of the material, such as its hardness. Hardness is usually measured on a Shore durometer scale in the range of Shore A 75 to Shore A 100 or harder. For example, hard wheels can slide more easily while softer wheels are can maintain higher speeds without sliding. Skateboard wheels have a wide surface engaging the ground, ranging from approximately 1 cm to over 5 cm. Traditionally, skateboarders have had to make compromises between control and a smooth ride on one hand and high speed on the other. Thinner wheels are generally made of relatively hard urethane, facilitating slides, grinds and other tricks. Thicker wheels are typically made with softer urethane for more control, making them suitable for, for example, downhill racing.

U.S. Pat. No. 6,953,225 discloses a skateboard wheel as initially defined. This wheel has a radial surface comprising outer portions and an inner portion between the outer portions, with a substantially linear border between them. Each of the three portions extends completely around the circumference of the wheel. The outer portions are made from a harder material than the inner portion, giving the outer portions a lower friction and thereby properties suitable for making tricks, especially involving sliding, while the inner portion has a higher friction thereby providing a higher degree of control, according to U.S. Pat. No. 6,953,225. The wheel has an axle passage through the centre with a bearing surface facing a hub for mounting the wheel on a skateboard. Hence, a designer of skateboard wheels can vary the properties of the wheels through selection of the hardness and friction coefficient of the materials used on the surface, and the width of the outer and inner portions of the wheels Similar considerations apply to other types of wheels, for example for roller skates or inline roller skates.

U.S. Pat. No. 4,699,432 discloses a safety wheel for use with, for example, roller skates or skateboards. The wheel is designed to provide improved traction and performance and comprises portions of a first material having a relatively low friction coefficient and a second material, softer than the first material and having a higher friction coefficient.

SUMMARY OF THE INVENTION

The invention relates to a wheel for sports equipment, such as a skateboard, a scooter, a snakeboard, a roller skate or an inline roller skate. The wheel has a radial surface arranged to provide contact with the ground comprising areas of at least a first material and areas of at least one additional material, said additional material or materials having mechanical properties differing from that of the first material. The first and additional second materials are arranged in such a way that they form a pattern on the radial surface which varies around the circumference of the wheel. The first and additional materials are chosen in such a way that they will form molecular bonding between them. Typically both materials will be polyurethane.

Said mechanical properties include but are not limited to hardness, rebound, abrasion, rate, coefficient of friction. Typically, a harder polyurethane material is used as the first material and a softer polyurethane is used as the second material. It would also be possible to use materials that have essentially the same mechanical properties but different colours. This would achieve a pattern in the wheel that would not be worn off in the same way as printed patterns on the surface.

By using polyurethane for both materials a molecular bonding can be achieved between the different areas. In contrast, when different types of materials are used, some sort of mechanical bonding must be used to keep the areas of different materials together. In practice, a wheel comprising two or more different types of polyurethane material can be made to function as one integral piece where the different areas cannot be separated from each other. As a consequence, there is no space between the different areas and no risk of rifts or crevices forming between the different areas. Such imperfections in the surface of the wheel serve to reduce the performance of the wheel so avoiding them is a major advantage. Further, the manufacturing process can be made more cost-efficient, since less effort will be needed to bond the areas of different materials together.

Varying the pattern of the two materials over the radial surface enables the wheel designer to modify the performance of the wheel beyond limitations in urethane materials. A design having different urethanes in alternating contact with the riding surface would give the rider the individual benefits of each material. The wheel can be adapted according to the intended use of the wheel, skills of the intended user, the surface on which the user will ride, or any other parameter.

Further, the visible differentiation a mix of materials in a pattern conveys a marketing benefit, since the patterns may be designed to look cool. Patterns may even be designed to reflect, for example, the logotype of a company or any other attractive image. This enables the differentiation of wheels from a particular manufacturer, or wheels having a particular set of properties just by looking at them.

In a preferred embodiment the surface is arranged so that only one of the first and additional second materials is in constant contact with the riding surface. The other material or materials form isolated areas, or islands, on parts of the radial surface. With alternating contact, the hard material gives stability and controls deformation and rolling resistance, the softer material gives better grip and higher rebound. By alternating materials we can engineer and optimize the wheel beyond previous limitations.

It would be possible to use a combination of more than two different materials as well.

In a preferred embodiment, the blended center surface is the principal weight supporting surface which interacts with the riding surface, because of its mix of materials in alternating contact enables the ability to manage the mechanical properties, tribology, and performance of the wheel.

In an alternative preferred embodiment, the blended center surface is combined with one or two outer portions of a similar type as in the prior art. In this case, the friction of the outer portions will be minimized, to facilitate tricks, while the friction of the center portion can be adapted as desired.

At any given moment more than one of the materials will normally be in contact with the riding surface, but the distribution between the materials will vary. By varying the design, size and pattern of the different materials we can affect the ride in the same way that alternating patterns on studded tires affect grip in snow. One material is engineered to give stability, while a second material gives grip and rebound. The degree of which any one material or a combination of two materials that is in alternating contact with the riding surface will vary depending upon the properties optimal for each type of skateboard wheel which is manufactured according to the patent technology.

In one embodiment the pattern of two different materials extends to at least one side of the wheel. This is particularly useful for applications in which the wheel may be tilted, for example for inline rollerskates.

The physics of wheels are the same for skateboarding, roller skating, inline skating, and scooters. All of these products utilize polyurethane wheels and therefore benefit from the ability to engineer the wheels properties through design.

BRIEF DESCRIPTION OF THE DRAWINGS

In the following embodiments of the invention will be described in detail, with reference to the appended drawings, in which FIGS. 1A-1C show different views of skateboard wheel according to a first embodiment of the invention.

FIGS. 2A and 2B show examples of what a section through the wheel of FIGS. 1A to 1C might look like.

DETAILED DESCRIPTION OF PREFERRED EMBODIMENTS

Figure 3A:
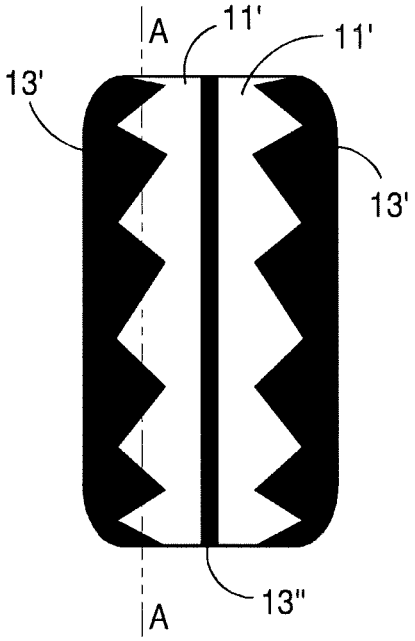
FIG. 3A is a view of part of the circumference of a skateboard according to an embodiment of the invention.

FIG. 1A is a perspective view of an embodiment of a wheel 1 according to the invention. The wheel has a hub 3, which exhibits an axle passage 5 for mounting on a skateboard, a rollerskate or the like. A bearing (not shown) is typically provided around the axle passage for smooth rotation of the wheel. The wheel has a tapered edge 7 and an outer surface 9 which forms the interface towards the ground. The tapered edge 7 and the outer surface 9 are primarily made from a first material 11 having a first set of mechanical properties, including a first hardness, shown in white in the Figure. Around the circumference of the wheel, a second material 13 having a second set of mechanical properties, including a second hardness, is applied in such a way that the outer surface 9 and/or the tapered edge 7 comprises areas of the first material 11 and areas of the second material 13. In this particular embodiment, the exterior surface around the circumference of the wheel comprises a central narrow line of the first material 11 surrounded by a feather-like pattern in which areas of the second material 13 extend from the central line to the edge outer surface around the whole circumference, interrupted by curved lines of the first material 11. In this embodiment, the edges 7 of the wheel are beveled, so that the first material surfaces at the edges and sides of the wheel.

The wheel may be made entirely from the first material, with only the areas of the second material applied as shown, or one or more other materials or compositions may be used for the interior or portions of the interior of the wheel. Alternatively, the wheel may have hollow portions inside, such as the chambers shown in FIG. 1.

FIG. 1B is a view of the wheel of FIG. 1*a*, seen from the side, including the hub 3, the axel passage 5 and the tapered edge 7. The pattern around the circumference is seen in the narrow outer circle as wider areas of the second material 13 interrupted by narrow areas of the first material 11.

FIG. 1C is a view of the wheel of FIGS. 1*a* and 1*b*, as seen towards the circumference of the wheel. The outer surface 9 is seen having a narrow central line of the first material 11 around its circumference and a feather-like pattern of the second material 13 extending from the narrow central line across the outer surface 9 towards the tapered edges 7.

FIG. 2A shows a section through the wheel of FIGS. 1A-1C according to a first embodiment. As can be seen, a core 15 made from the material forming the hub 3 extends radially from the axel passage 5 to form the major part of the wheel. This core 15 is covered, around the areas that are adapted to connect to the ground, by a layer of the first material 11 constituting the main part of the wheel. The areas of the second material 13 extend a relatively short distance into the first material as can be seen in the Figure.

Figure 6:
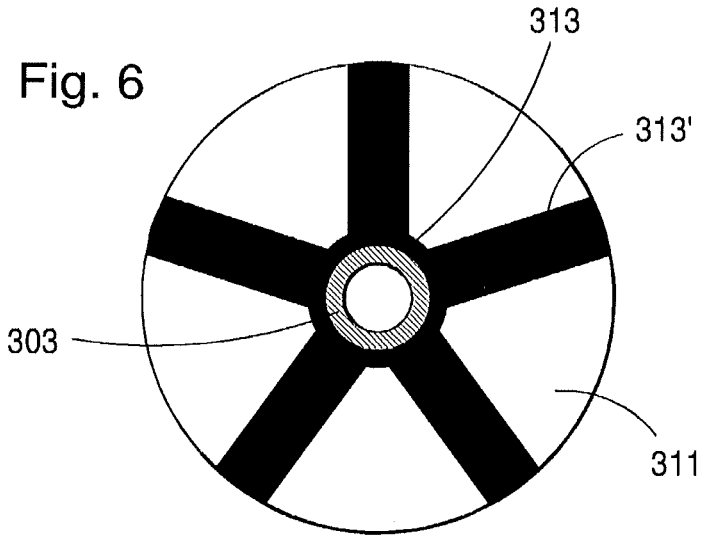
FIG. 6 shows a section trough a wheel according to an embodiment of the invention.

FIG. 2B shows a section through the wheel of FIGS. 1A-1C according to an alternative embodiment. As can be seen, the hub 3 in the middle is surrounded by an area of the first material 11 constituting the main part of the wheel. The areas of the second material 13 extend a longer distance into the first material as can be seen in the Figure. Of course, the areas of the second material 13 could extend longer or shorter into the first material. For example, it could extend halfway, or more than halfway in, or approximately as shown in FIG. 2A. FIG. 6 below shows yet another possible implementation.

Although the Figures show wheels suitable for a skateboard, using two or more different materials having different mechanical properties in the outer surface of the wheel can be utilized in wheels for a number of different applications, including rollerskates, inlines, snakeboards and scooters. How to make such wheels is well known in the art, including dimensions, shapes, how to arrange the hub, the use of bearing, etc. The only change that is made according to the invention lies in how the surface material is applied to the wheel.

FIG. 3A shows a second embodiment of the wheel, seen towards the circumference of the wheel. The side view would be essentially as shown in FIG. 1A. In this embodiment, the second material is applied in three areas: a first and a second band 13' around the edges of the wheel and a band 13" in the middle. The borders between the first and second bands 13' and the areas 11' of the first material have a serrated shape. Of course, the borders could have any shape that was not entirely linear, since a variation should be provided around the circumference of the wheel.

Figure 3B:
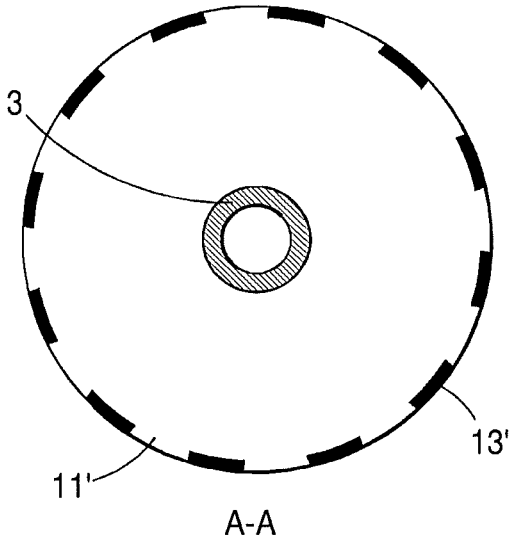
FIG. 3B is a section through the skateboard wheel of FIG. 2A.

FIG. 3B shows a section through the line A-A of FIG. 3B. As in FIG. 2B, the second material forms the main part of the wheel, extending from the hub 3 all the way to the circumference. In the example shown, areas of the second material extend a short way into the first material around the circumference. Of course, the wheel of FIG. 3A could also be implemented in the different ways discussed in connection with FIGS. 2A and 3A.

Figure 4A:
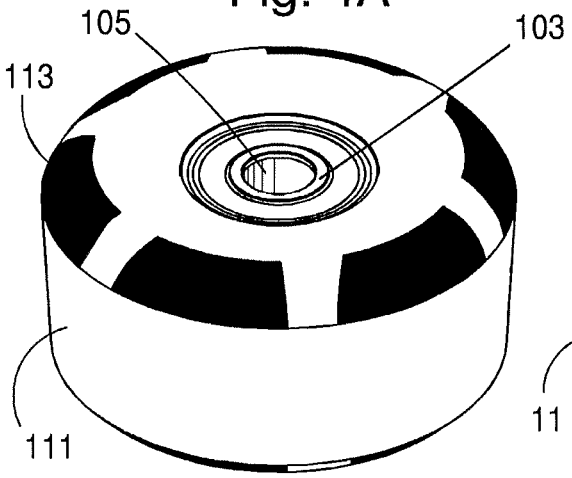
FIG. 4A shows a third embodiment of a wheel according to the invention.

FIG. 4A shows a third embodiment of the wheel. As in FIG. 1A, a hub 103 is surrounded by a first material 111 making up the main part of the wheel. Areas of a second material 113 are placed in the beveled portions of the wheel, only. FIG. 2B shows a section through the wheel of FIG. 2A, in which areas of the second material 113 extend a short distance into the first material at the beveled side portions of the wheel.

Figure 4B:
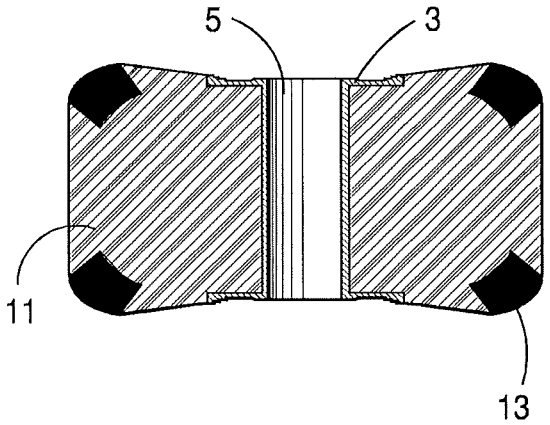
FIG. 4B is a section view of the wheel of FIG. 4A.

FIG. 4B shows a section through the wheel of FIG. 4A. In this example, the second material 113 extends only a short distance into the first material 111. Of course, the wheel of FIG. 4A could also be implemented in the different ways discussed in connection with FIGS. 2A and 3A.

Figure 5:
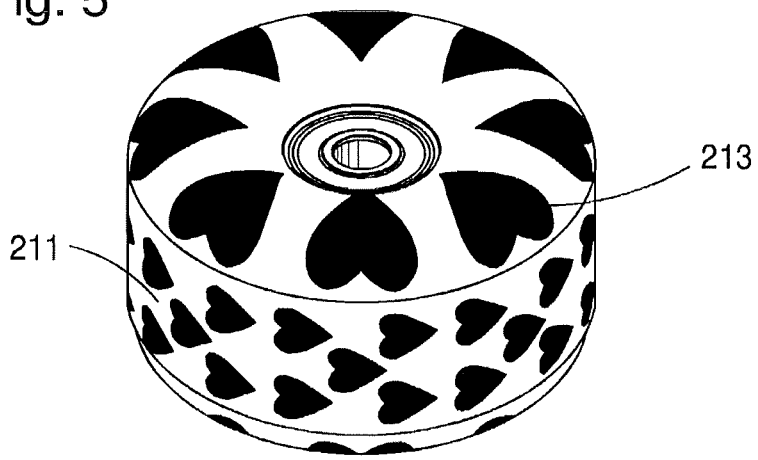
FIG. 5 shows a fourth embodiment of a wheel according to the invention.

FIG. 5A shows a fourth embodiment of a wheel to illustrate that the first 211 and second 213 materials may be arranged in any pattern on the circumference of the wheel. In this particular example, the areas of the second material are heart shaped. The section through the wheel could be as any of the embodiments discussed above, or as discussed in connection with FIG. 6.

FIG. 6 shows an alternative section through a wheel having a hub 303 around an axel passage 305. In this embodiment the second material is arranged to form a band 313 around the hub. The first material 311 is arranged around the band 313 and extends to the circumference. The band has arms 313' extending radially through the first material towards the circumference of the wheel, to form areas of the second material in the first material on the surface. The cross-section of the arms 313' may have any shape, typically corresponding to the pattern that should be made around the circumference of the wheel. For example in the wheel of FIG. 5 the cross-section could be heart-shaped.

The wheel according to the invention may be produced in a number of different ways, as will be clear to the person skilled in the art. For example, the core of the wheel is made of the first material and extends from the hub 3 of the wheel all the way to the outer surface. The core is then place in a mold shaped like the outer shape of the wheel. The second material is poured into the mold and forms the outer surface of the wheel fused with the first material of the core. Alternatively, it would be possible to make the wheel of the second material and apply the first material only around the outer surface.

Alternatively a patterned insert ring with an outer diameter matching the outer surface of the wheel is molded. This ring is then placed in a mold and the second material is poured into the mold and forms the outer surface of the wheel fused with the first material of the ring. An optimal thickness of the ring would be in the range from 2 mm to 10 mm.

A third option would be to make a wheel of the first material with cavities in the first material and fill in the cavities using the second material. The cavities can be made as deep as desired, from extending about 1 millimeter into the wheel to 25 millimeters into the wheel, or extending all the way to the hub. A preferred thickness would be 6 mm to 7 mm.

The diameter of the wheel varies depending on the type of wheel, as the skilled person will be aware. For skateboard wheels, the diameter is typically within the range from 45 mm to 60 mm for a street wheel, between 55 mm and 70 mm for a park/vert/transition wheel. A longboard speed wheel typically has a diameter between 60 mm and 120 mm.

The shape of a wheel and the width of the wheel contacting the riding surface also depends on the type of wheel. An inline, snakeboard or scooter wheel has an elliptical form and the portion contacting the riding surface is very narrow, from 2 mm to 15 mm.

A skateboard wheel the width of the portion contacting the riding surface starts at 15 mm for a 360 freestyle wheel. For a street skateboard wheel it is typically between 20 mm and 30 mm, and for a park/vert/transition wheel it is typically between 25 mm and 40 mm. The contacting portion of a longboard wheel is typically 35 mm to 80 mm.

As the skilled person will understand, the dimensions given above are merely intended as examples and are not limiting in any way. Further, the wheel according to invention is not limited to the uses mentioned. The wheel can be made in the conventional way for the intended use, apart from the combination of two or more surface materials as discussed in this document.

The invention claimed is:

1. A wheel having a radial surface arranged to provide contact with the ground, said radial surface comprising areas of at least a first material and areas of at least a second material, said second material having at least one mechanical property differing from that of the first material, wherein the first and second materials are arranged in such a way that they form a pattern on the radial surface which varies around the circumference of the wheel, wherein said wheel has beveled side portions, and wherein the first and second materials are arranged in such a way that they form a pattern on at least one of the beveled side portions which varies around the circumference of the side portion.

2. A wheel according to claim 1, wherein the at least one mechanical property includes at least one of hardness, coefficient of friction, rolling resistance and rebound.

3. A wheel according to claim 1, having at least one outer portion extending around at least one edge of the radial surface of the wheels, and a central portion comprising the radial surface with a varying pattern, the central surface constituting the principal weight supporting surface arranged to interact with the riding surface.

4. A wheel according to claim 1, wherein the first and second areas are arranged in such a way that the first areas surround islands of the second material, forming a pattern on the radial surface.

5. A wheel according to claim 1, wherein each of the first and second materials forms continuous bands around the radial surface, the widths of said bands varying around the circumference.

6. A wheel according to claim 1, wherein the first material forms a center band along the center of the wheel and the second material forms a side band on each side of the center band extending substantially to the edges of the wheel, wherein lines of the first material extend from the center band to the edges of the wheel, interrupting the side bands.

7. A wheel according to claim 1, wherein one of the first and the second material extends from the outer surface of the wheel to the hub and the other material is substantially limited to the outer surface of the wheel.

8. A wheel according to claim 1, wherein one of the first and the second material extends within the wheel from the outer surface of the wheel to the hub and the other material extends at least halfway from the outer surface toward the hub.

9. A wheel according to claim 1, wherein the second material is arranged in a band around the hub and the first material is arranged around the band, the second material extending radially to the circumference of the wheel, the second material forming arms extending from the band to the circumference to form a pattern of the first and second materials around the circumference.

10. A wheel according to claim 1, said wheel being adapted for use on a skateboard, an inline skate, a snakeboard or a rollerskate.

11. A wheel according to claim 1, wherein the first material is a first polyurethane material and the second material is a second polyurethane material.

12. A wheel according to claim 11, wherein the first and second areas are arranged in such a way that the first areas surround islands of the second polyurethane material, forming a pattern on the radial surface.

13. A wheel according to claim 11, wherein each of the first and second polyurethane materials forms continuous bands around the radial surface, the widths of said bands varying around the circumference.

14. A wheel according to claim 11, wherein the first polyurethane material forms a center band along the center of the wheel and the second polyurethane material forms a side band on each side of the center band extending substantially to the edges of the wheel, wherein lines of the first polyurethane material extend from the center band to the edges of the wheel, interrupting the side bands.

15. A wheel according to claim 11, wherein one of the first and the second polyurethane material extends from the outer surface of the wheel to the hub and the other polyurethane material is substantially limited to the outer surface of the wheel.

16. A wheel according to claim 11, wherein one of the first and the second polyurethane material extends within the wheel from the outer surface of the wheel to the hub and the other polyurethane material extends at least halfway from the outer surface toward the hub.

17. A wheel according to claim 11, wherein the second polyurethane material is arranged in a band around the hub and the first polyurethane material is arranged around the band, the second polyurethane material extending radially to the circumference of the wheel, the second polyurethane material forming arms extending from the band to the circumference to form a pattern of the first and second polyurethane materials around the circumference.

* * * * *